US006901820B2

(12) United States Patent
Imahara

(10) Patent No.: US 6,901,820 B2
(45) Date of Patent: Jun. 7, 2005

(54) DEVICE FOR DETECTING WIDTH OF SHEET-LIKE MEDIUM, AND IMAGE FORMATION APPARATUS

(75) Inventor: Minoru Imahara, Saitama (JP)

(73) Assignee: Ricoh Company, Limited, Tokyo (JP)

( * ) Notice: Subject to any disclaimer, the term of this patent is extended or adjusted under 35 U.S.C. 154(b) by 100 days.

(21) Appl. No.: 10/358,339

(22) Filed: Feb. 5, 2003

(65) Prior Publication Data

US 2003/0151188 A1 Aug. 14, 2003

(30) Foreign Application Priority Data

Feb. 6, 2002 (JP) ..... 2002-029021
Dec. 20, 2002 (JP) ..... 2002-370108

(51) Int. Cl.[7] ..... G01M 19/00; G03G 15/00
(52) U.S. Cl. ..... 73/865.8; 399/389
(58) Field of Search ..... 73/865.9, 865.8; 399/376, 45, 389; 400/708.1; 338/176; 271/171, 228, 227, 265.01

(56) References Cited

U.S. PATENT DOCUMENTS 4,954,846 A * 9/1990 Matsuo et al. ..... 399/51
5,119,130 A * 6/1992 Tsudaka et al. ..... 399/376
5,122,833 A * 6/1992 Sato ..... 399/376
5,574,551 A * 11/1996 Kazakoff ..... 399/45
5,940,106 A * 8/1999 Walker ..... 347/104
6,267,522 B1 * 7/2001 Slippy et al. ..... 400/708.1

FOREIGN PATENT DOCUMENTS

JP 5-43058 2/1993
JP 05043058 A * 2/1993 ..... B65H/1/00
JP 8-290835 11/1996
JP 11-130271 5/1999

* cited by examiner

*Primary Examiner*—Hezron Williams
*Assistant Examiner*—John Fitzgerald
(74) *Attorney, Agent, or Firm*—Oblon, Spivak, McClelland, Maier & Neustadt, P.C.

(57) ABSTRACT

A paper whose width is to be detected is placed on a base. Two limiting members that can move towards or away from each other are situated on the two sides of the paper. The limiting members are moved to make a physical contact with the side of the paper. In this state, a rotation angle detection sensor detects an angle based on positions of the limiting members and outputs a signal based on the angle and an auxiliary sensor judges presence or absence of the limiting members in a certain range and outputs a signal. A width detection sensor detects the width of the paper based on the signals output from the rotation angle detection sensor and the auxiliary sensor.

7 Claims, 16 Drawing Sheets

DEVICE FOR DETECTING WIDTH OF SHEET-LIKE MEDIUM, AND IMAGE FORMATION APPARATUS

BACKGROUND OF THE INVENTION

1) Field of the Invention

The present invention relates to a device (hereinafter "width detecting device") for detecting a width of a sheet-like medium for use, for example, in a paper feeder of an image formation apparatus such as a copying machine, a printer, a facsimile, or the like.

2) Description of the Related Art

A width detecting device for detecting a width of a sheet-like medium (i.e., a paper) has been disclosed in, for example, Japanese Patent Application Laid Open No. 5-43058. When it is assumed that the paper has a paper length direction and a paper width direction, then in this width detecting device, two limiting members are disposed parallel to the paper width direction and facing with each other on a base for placing the paper. These limiting members are arranged so as to move towards each other or away from each other, along the paper width direction via an interlocking unit. The limiting members are moved so that they make a contact with the respective edges of the paper, and a detecting unit detects the position of the limiting members to thereby detect the width of the paper.

The detecting unit includes a plurality of resistors having different resistances positioned at predetermined positions in the base along the paper width direction, and one contact element is positioned in each of the limiting plates. When the limiting plates are moved, the contact elements in the limiting plates make an electrical contact with the resistors in the base, and an electrical path is created. The detecting unit further includes a voltmeter that measures the voltage of this electrical path. Based on the voltage, it is possible to decide with which resistors the contact elements have made the electrical contact and thereby it is possible to decide the width of the paper because the positions of the resistors are known.

In this configuration there is a problem that the contact (hereinafter "contact pressure") between the resistor and the contact element varies depending upon variation in the size of the parts, conditions at the time of assembly, and environmental conditions.

If the contact pressure is strong, the limiting plates may move because of the contact pressure, or it may become difficult to move the limiting plates because of the contact pressure. If the contact pressure is weak, an error may be generated in the detection of the width of the paper. If it is incorrectly detected, for example, that the paper is wider, an unnecessary portion is developed so as to increase the load on a cleaning device or excessive consumption of a toner can be generated. Moreover, since a relatively large resistor area is needed, the miniaturization of the width detecting device is not satisfied.

As a sensor for detecting an amount of movement (hereinafter "moving amount") of a subject, a rotation angle detection type sensor that converts the moving amount into an angle and generates a signal corresponding to the angle is known. Some prior arts have used the rotation angle detection type sensor in combination with the limiting plates described above to detect the width of the paper. In that case, the rotation angle detection type sensor converts the amount of movement of the limiting plates into angles and determines the width of the paper.

The rotation angle detection type sensor can accurately detect the width of the paper when the angle is less than 360°, but can not properly detect the width when the angle is more than 360°. Because, since the pattern of the signal output by the rotation angle detection type sensor when the angle is less than 360° is the same as when it is greater than 360°, it is impossible to distinguish whether the angle is less than 360° or greater than 360°.

A width detecting device of manual feeding paper base is disclosed in, for example, Japanese Patent Application Laid Open No. 11-130271. This width detecting device has a rotation type variable resistor whose resistance varies according to a rotation angle of a shaft section. This width detecting device detects the paper width based on the resistance output by the rotation type variable resistor.

Generally, a paper of size A3 or smaller is used in the image formation device. It is possible to detect the width of the A3 size paper with the rotation angle detection type sensor or the rotation type variable resistor because the angle corresponding to the A3 size paper is less than 360°.

However, recently, there is an increasing demand to increase the paper size that can be handled in the image formation apparatus. If the size of the paper is increased, then the angle corresponding to that paper is greater that 360°, and the conventional rotation angle detection type sensor or the rotation type variable resistor do not give proper results. To get proper results, a gear used in the rotation angle detection type sensor should be made larger. If the gear is made larger, then extra space is required to accommodate the gear. Moreover, the number of switches used in the rotation angle detection type sensor increase. This leads to cost increase.

SUMMARY OF THE INVENTION

It is an object of the present invention to provide a width detecting device capable of detecting the width of a wider sheet-like medium in a compact configuration.

The width detecting device according to one aspect of the present invention comprises a placing base for placing a sheet-like medium having a first side and a second side perpendicular to a width direction of the sheet-like medium; a first limiting member situated on the first side and a second limiting member situated on the second side of the sheet-like medium; an interlocking unit that moves the first limiting member and the second limiting member along the width direction; a rotation angle detection sensor that detects an angle based on positions of the first limiting member and the second limiting member and outputs an angle signal based on the angle; and an auxiliary sensor that judges any one of presence and absence of the first limiting member and the second limiting member in a moving range of the first limiting member and the second limiting member and outputs a presence/absence signal based on the judgment; and a width detection sensor that detects the width of the sheet-like medium based on the angle signal and the presence/absence signal.

The image formation apparatus according to another aspect of the present invention employs the width detecting device according to the present invention.

These and other objects, features and advantages of the present invention are specifically set forth in or will become apparent from the following detailed descriptions of the invention when read in conjunction with the accompanying drawings.

DETAILED DESCRIPTION

Exemplary embodiments of the width detecting device for detecting a width of the paper according to the present invention are explained below with reference to accompanying drawings. The invention is by no means limited to these embodiments.

Figure 1:
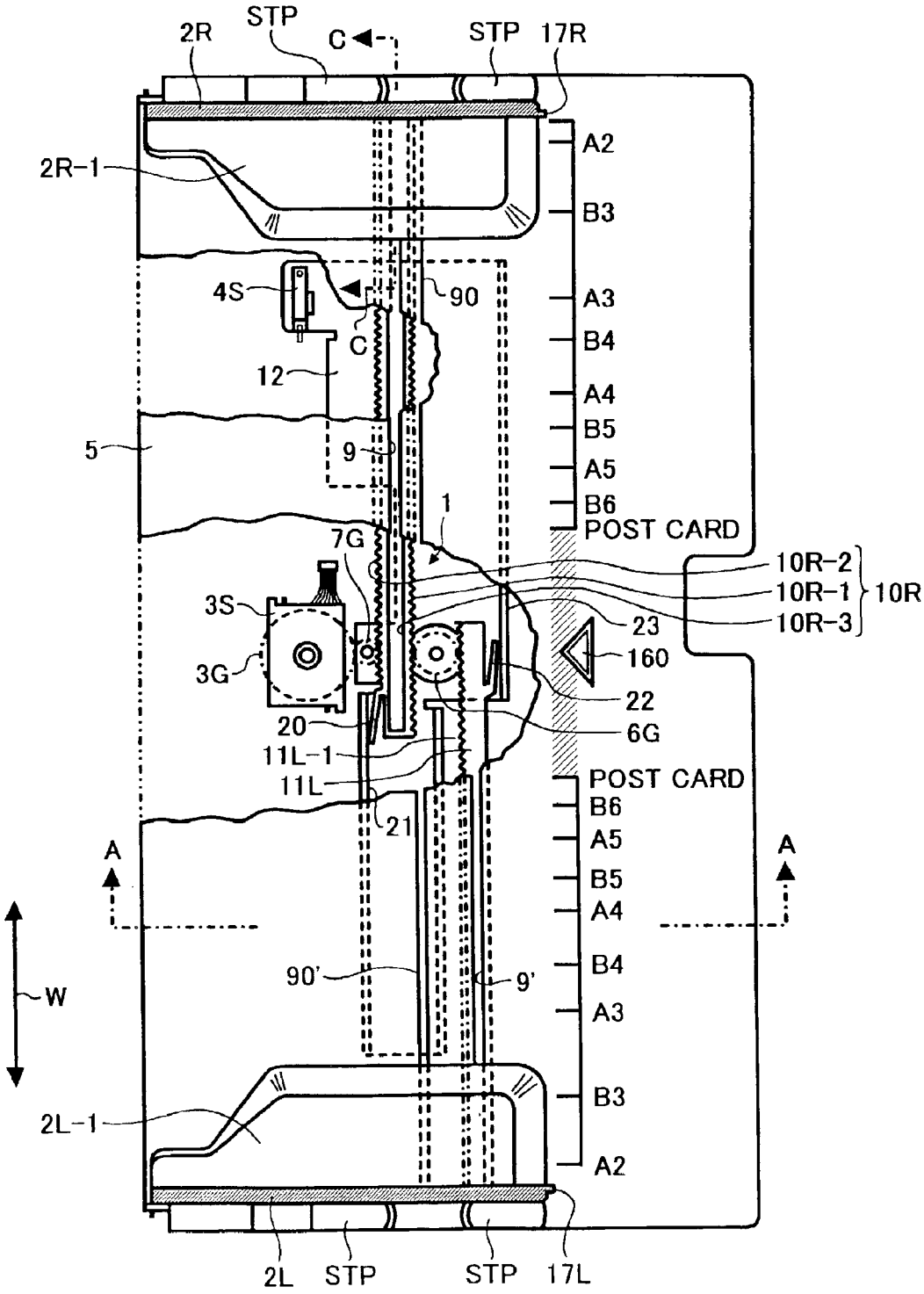
FIG. 1 is a plan view that shows a width detecting device according to one embodiment of the present invention.
Figure 2:
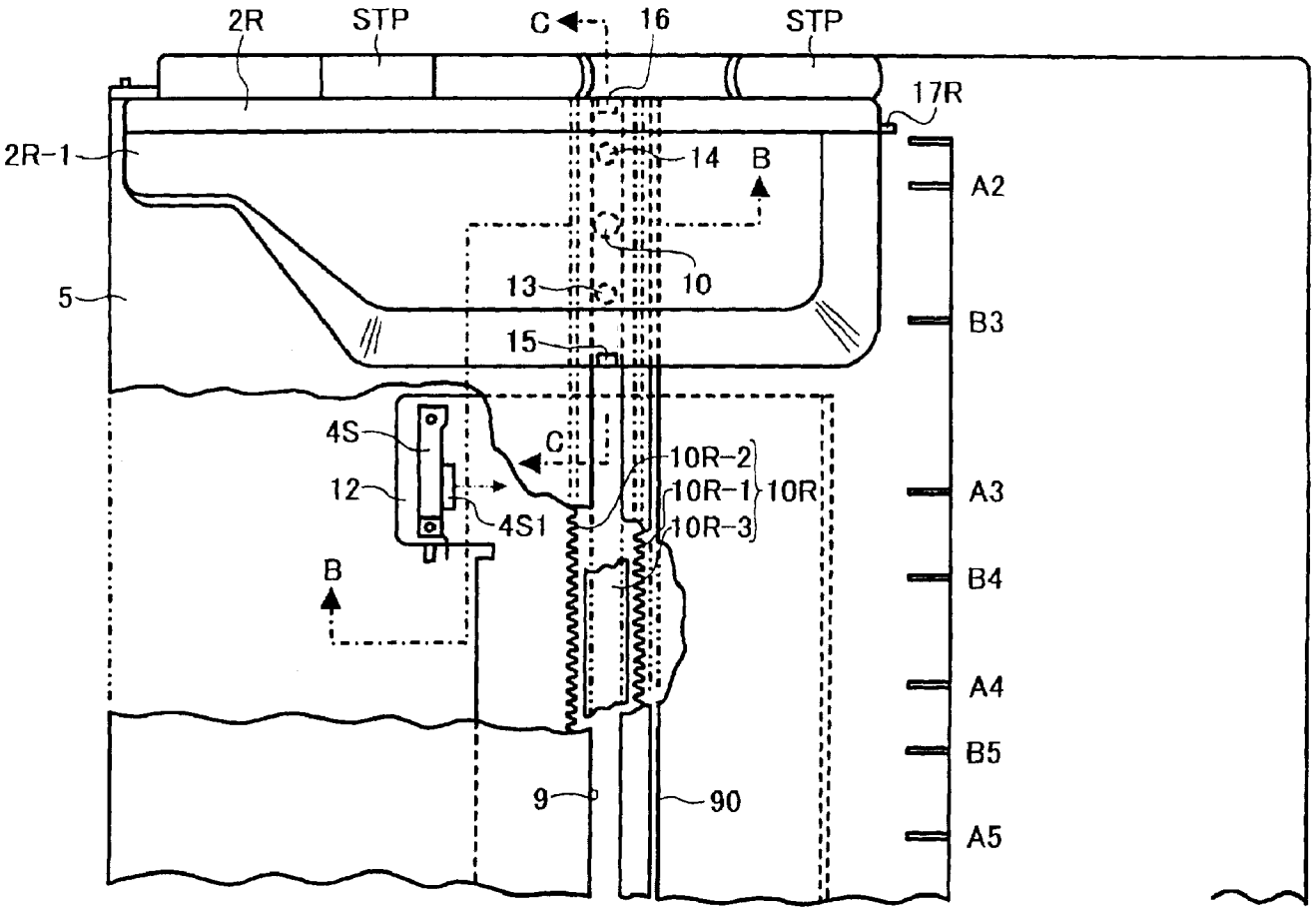
FIG. 2 is an enlarged plan view of a portion in FIG. 1.

FIG. 1 and FIG. 2 show a width detecting device according to one embodiment of the present invention. This width detecting device comprises a first limiting member 2R and a second limiting member 2L disposed facing with each other on a placing base 5 for placing a paper. The first limiting member 2R and a second limiting member 2L can move towards or away from each other via an interlocking unit 1 so as to make a physical contact with respective edge of the paper.

A paper is placed on the placing base 5 and the first limiting member 2R and the second limiting member 2L are moved in the width direction W so as to make a physical contact with the respective edges of the paper. In this state, a sensor detects the position of any one of the first limiting member 2R and the second limiting member 2L.

As the sensor, a rotation angle detection type sensor 3S for converting the moving amount of the first limiting member 2R (or the second limiting member 2L) into an angle and generating a signal corresponding to the angle, and an auxiliary sensor 4S capable of judging existence or absence of the first limiting member 2R in the moving range of the first limiting member 2R are provided so that the paper width size can be detected based on the output from the sensors 3S, 4S.

An interlocking unit 1 comprises a first rack member 10R, a second rack member 11L, a motion transmitting pinion 6G, or the like. The first rack member 10R having a longitudinal rectangular bar-like shape is provided integrally with the first limiting member 2R as well as it comprises a first rack 10R-1 in the width direction W.

The second rack member 11L having a longitudinal rectangular bar-like shape is provided integrally with the second limiting member 2L as well as it comprises a second rack 11L-1 formed in the width direction W, facing the first rack 10R-1. The motion transmitting pinion 6G is disposed between the first rack 10R-1 and the second rack 11L-1 so as to be engaged commonly with the first rack 10R-1 and the second rack 11L-1.

For the first rack member 10R, a paper width detecting rack 10R-2 is formed on the rear side of the first rack so as to be engaged with a gear 3G of the rotation angle detection type sensor 3S via an interlocking gear 7G engaged with the width detecting rack 10R-2.

The structure of the members and the coupling relationship of the members with each other are explained in further details.

The first limiting member 2R comprises a portion provided upright in the vertical direction as shown in the cross-section in FIG. 1, and a supporting section 2R-1 bent in the 90° direction with respect to the section shown in the cross-section, for supporting the paper width direction end. For the second limiting member, the section is referred to as the numeral 2L-1.

Figure 3:
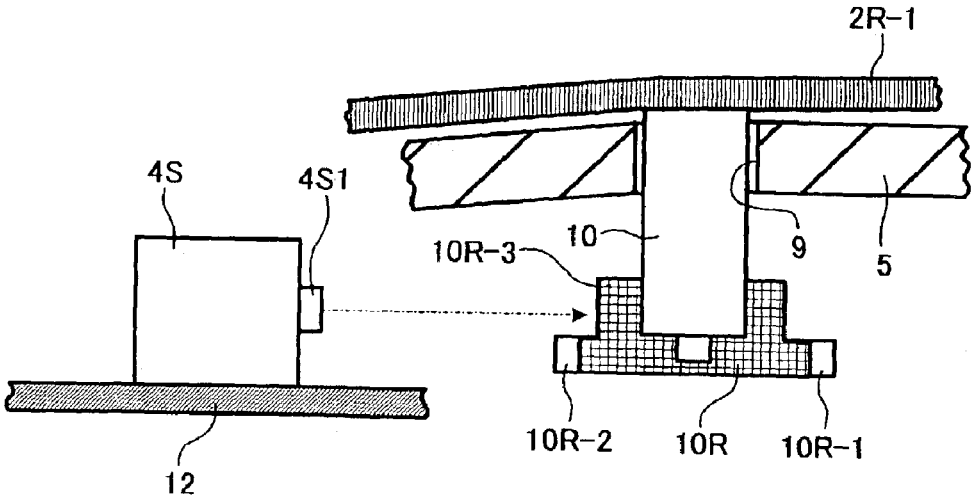
FIG. 3 is a cross-sectional view viewed from the arrows B—B of FIG. 2.

In FIG. 3 as a cross-sectional view viewed from the arrows B—B of FIG. 2, the width direction W is the direction orthogonal to the paper surface of FIG. 3. The placing base 5 is a plate-lime member for placing a paper on the upper surface thereof. As shown also in FIGS. 1 and 2, a guide groove 9 is formed parallel to the width direction W.

The guide groove 9 is pierced through by an interlocking shaft 10 slidably. The upper portion of the interlocking shaft 10 is provided integrally with the supporting section 2R-1, and a one end side of the first rack member 10R is fixed with the lower part thereof. The relationship of these members is shown further apparently in FIGS. 4 and 5.

Figure 6:
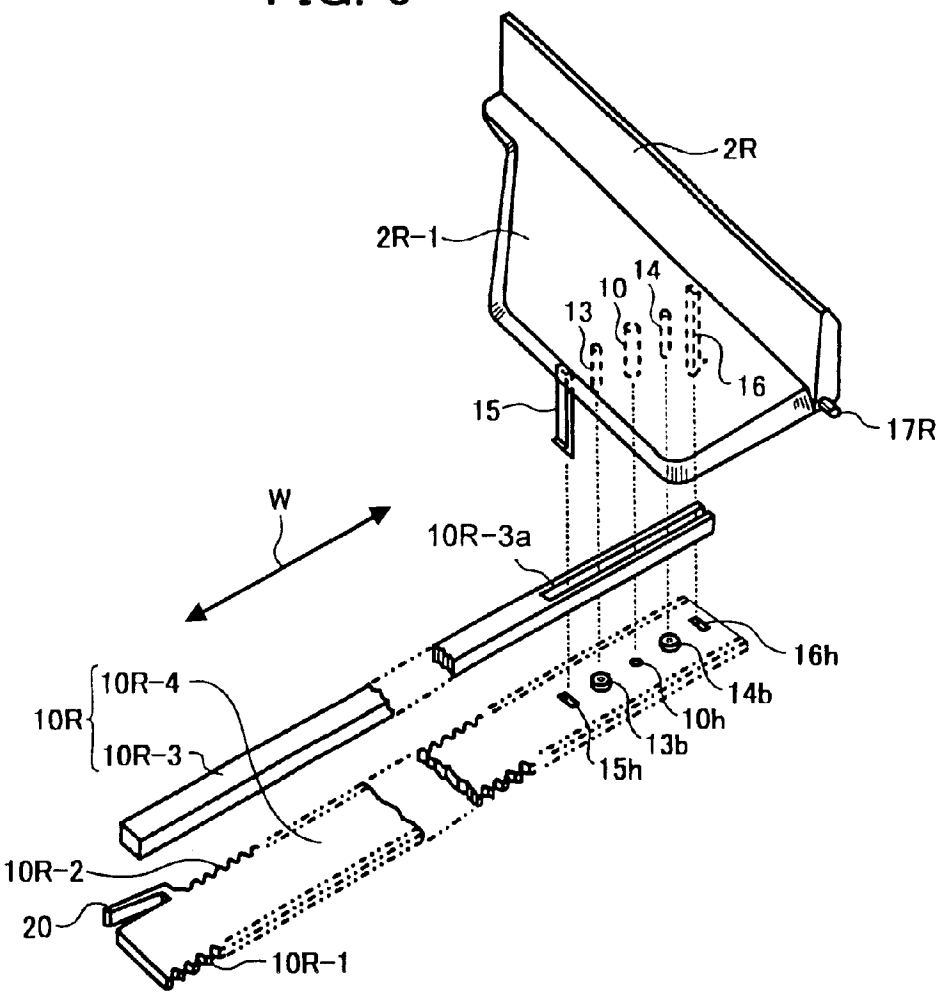
FIG. 6 is an exploded perspective view that explains the coupling relationship between a first limiting member and a first rack member.
Figure 7:
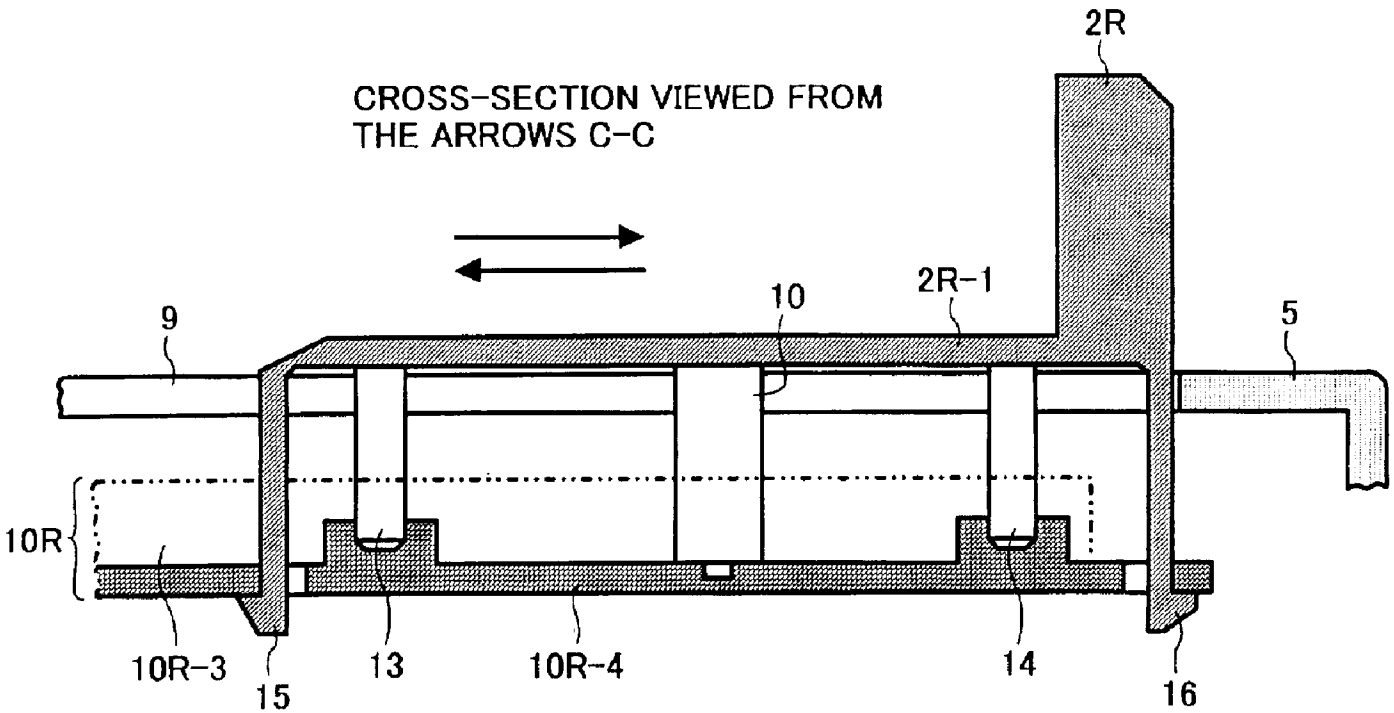
FIG. 7 is a cross-sectional view viewed from the arrows C—C of FIG. 1 that explains the coupling relationship between the first limiting member and the first rack member.

As shown in FIGS. 6 and 7, the supporting section 2R-1 and the first rack member 10R are integrated by locking with pawl members 15, 16 via shafts 13, 14 for determining the interval between the supporting section 2R-1 and the first rack member 10R and fixing them in addition to the fixing shaft 10.

As shown in FIG. 6, in order to support the pawl member 15, the shaft 13, the interlocking shaft 10, the shaft 14, the pawl member 16, or the like, in the first rack member 10R, a through opening 15*h*, a boss hole 13*b*, a hole with the bottom 10*h*, a boss hole 14*b* and a through opening 16*h* are formed in the first rack member 10R. The supporting section 2R-1 and the first rack member 10R are integrated via the pawl member 15, the shaft 13, the interlocking shaft 10, the shaft 14, the pawl member 16, or the like.

In FIG. 6, in the first rack member 10R, a convex portion 10R-3 is formed as a section to be detected for having the existence or absence thereof detected by the sensor 4S. The convex portion 10R-3 is provided integrally with the first rack member 10R, however, for the explanation convenience, it is shown independently from a rack forming section 10R-4 in FIG. 6. The first rack member 10R is produced integrally by a resin molding process.

A groove 10R3*a* is formed in the longitudinal direction end of the convex portion 10R such that the pawl member 15, the shaft 13, the interlocking shaft 10, the shaft 14, the pawl member 16, or the like are fixed with the rack section 10R-4 via the groove 10R-3*a*. Moreover, for smooth movement in the width direction W of the first limiting member 2R, a guide groove 90 is provided in addition to the guide groove 9.

Based on the coupling relationship between the first rack member 10R and the supporting section 2R-1, the second rack member 11L and the supporting section 2L-1 are coupled, however, explanation is omitted. Moreover, as those corresponding to the guide grooves 9, 90, guide grooves 9', 90' are provided such that the second limiting member 2L is moved, interlocking with the first limiting member 2R via the guide grooves 9', 90'.

Figure 4:
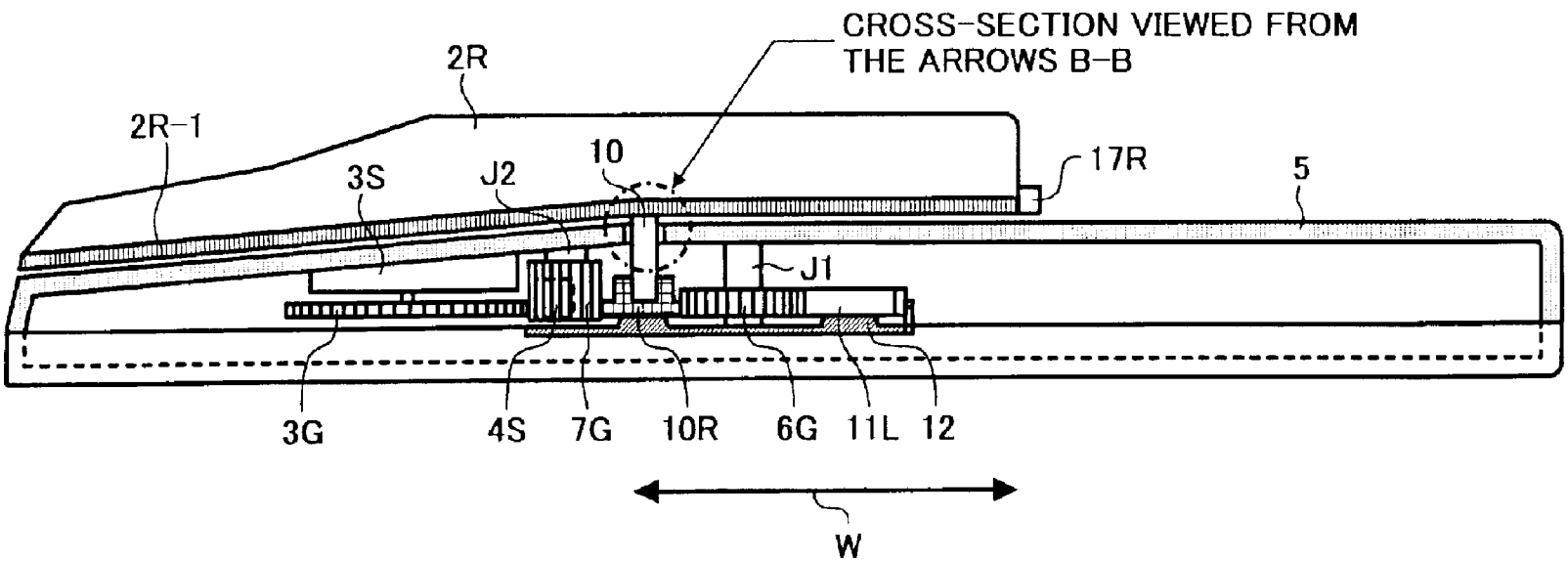
FIG. 4 is a cross-sectional view viewed from the arrows A—A of FIG. 1 (partially including the cross-section viewed from the arrows B—B)
Figure 5:
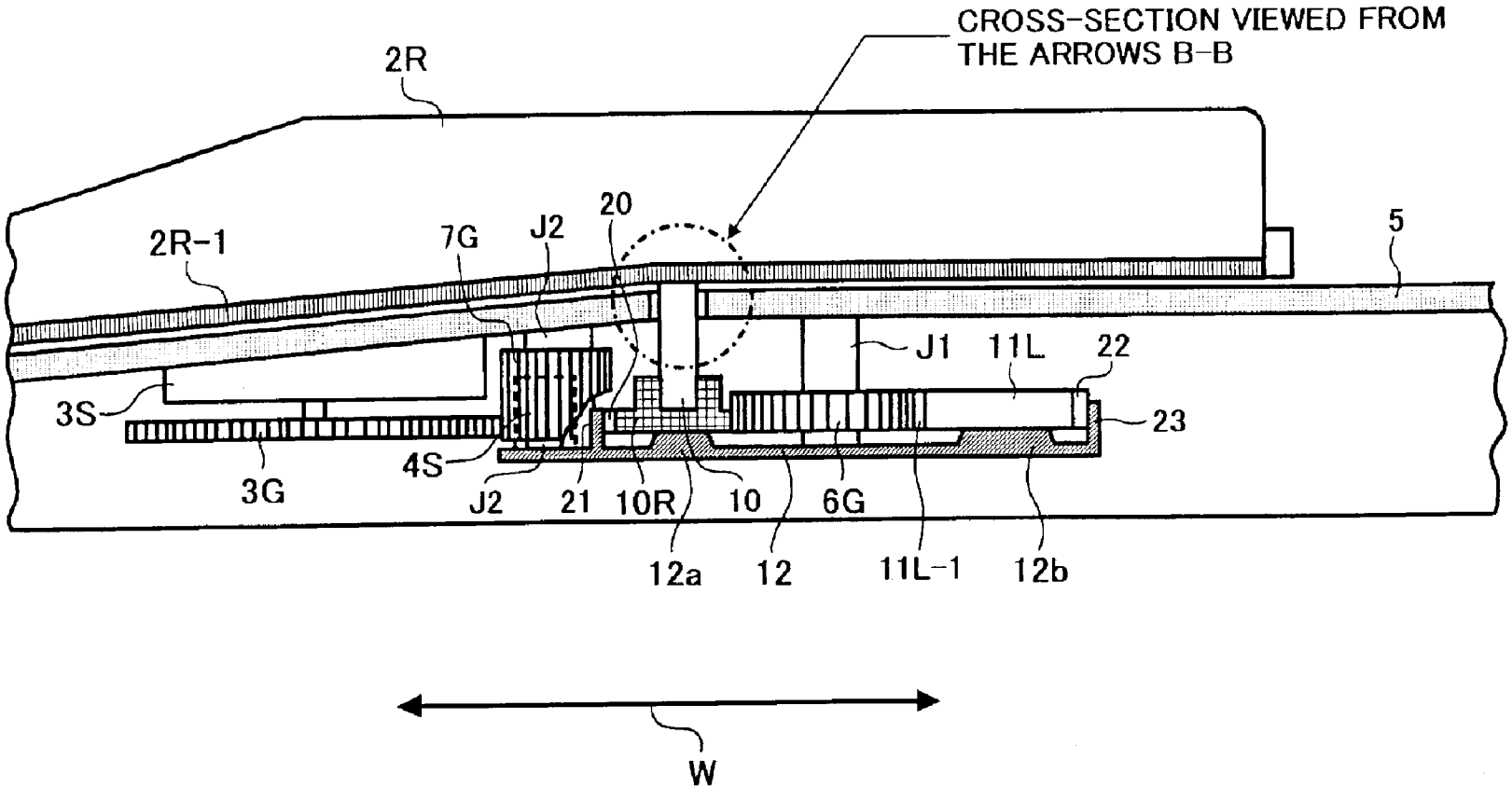
FIG. 5 is a view of a portion in FIG. 4.

As shown in FIGS. 3 to 5, a retainer plate 12 is provided below the plate-like placing base 5 with an interval. The retainer plate 12 is a plate-like member integrated with or provided integrally with the placing base 5 via a column member (not shown), having the rigidity.

As shown in FIGS. 4 and 5, the rotation angle detection type sensor 3S is fixed on the rear surface of the placing base 5, and the motion transmitting pinion 6G and the interlocking gear 7G are pivoted by shafts J1, J2 provided on the rear surface of the placing base 5.

The shafts J1, J2 for supporting the motion transmitting pinion 6G and the interlocking gear 7G stably support the motion transmitting pinion 6G and the interlocking gear 7G by having the lower ends thereof supported by the retainer plate 12.

According to the configuration, by grasping the first limiting member 2R (or the second limiting member 2L) with a hand and moving in the width direction W, the second limiting member 2L (of the first limiting member 2R) is moved by the same amount in the opposite direction with respect to a mark 160 that shows the center so as to be disposed at a position contacting with the side portion of the paper placed on the placing base 5.

Since both the first rack 10R-1 and the second rack 11L-1 are engaged with the motion transmitting pinion 6G, the first limiting member 2R and the second limiting member 2L are moved by the same distance in the opposite directions. Therefore, regardless of the paper size, the center position in the width direction W of the placed paper is always provided constantly at the mark 160 position.

In this embodiment, scale lines and the size names representing the same are printed on the placing base 5 in the width direction W with respect to the mark 160 at positions representing the sizes of postcard, B6, A5, B5, A4, A3, B3, A2.

In the first limiting member 2R and the second limiting member 2L, projections 17R, 17L are provided for representing the scale lines. For example, when the projection 17R of the first limiting member 2R is aligned with the scale line of the postcard, the interval between the first limiting member 2R and the second limiting member 2L provides the postcard size. The same is applied to the other sizes. The same effect can be achieved by aligning the projection 17L of the second limiting member 2L.

The movement of the first rack member 10R is transmitted to the gear 3G via the interlocking gear 7G so that the rotation amount is converted to an angle by the rotation angle detection type sensor 3S for outputting a signal corresponding to the angle. That is, four signals are changed according to the rotation angle of the gear 3G.

According to the present invention, the paper size is detected by the signal detection results of the rotation angle detection type sensor 3S and the auxiliary sensor 4S. For example, when a paper is placed on the placing base 5 provided as a paper manual feeding base and the paper is interposed between the first limiting member 2R and the second limiting member 2L in the width direction W, the first rack 10R-1 and the second rack 11L-1 are moved. According to the movement of the first rack 10R-1, the interlocking gear 7G to be engaged with 10R-2 is rotated and the gear 3G of the rotation angle detection type sensor 3S is rotated as well.

According to the gear rotation angle, the output signal from the rotation angle detection type sensor 3S is changed. Moreover, the auxiliary sensor 4S is disposed at a position capable of detecting the first rack member 10R-1 provided integrally with the first limiting member 2R. By detecting the output signals from the rotation angle detection type sensor 3S and the auxiliary sensor 4S, the paper width of the placed paper can be found.

The relationship between the paper sizes and the output signal from the rotation type switch with a gear 9 and the reflection type sensor 10 is shown in the following table 1.

[Table 1]

Relationship between the paper size and the rotation angle detection type sensor and the auxiliary sensor

| NO | Paper size | Gear angle | Signal 1 | Signal 2 | Signal 3 | Signal 4 | Signal 5 |
|---|---|---|---|---|---|---|---|
| 1 | Postcard (100 mm) | 0° | H | L | L | L | L |
| 2 | B6 (128 mm) | 40.5° | H | H | L | L | L |
| 3 | A5 (148 mm) | 71.3° | H | H | L | L | L |
| 4 | B5 (182 mm) | 119.9° | L | H | H | L | L |
| 5 | A4 (210 mm) | 184.7° | L | L | H | L | L |
| 6 | B4 (257 mm) | 231.3° | L | L | H | H | L |
| 7 | A3 (297 mm) | 288.1° | L | L | L | H | L/H |
| 8 | B3 (364 mm) | 351.6° | L | L | L | L | H |
| 9 | B3 (364 mm) | 360° | H | L | L | L | H |
| 10 | B3 (364 mm) | 40.5° | H | H | L | L | H |
| 11 | B3 (364 mm) | 71.3° | L | H | L | L | H |
| 12 | A2 (420 mm) | 119.9° | L | H | H | L | H |

Note 1: The signals 1 to 4 are the output from the rotation angle detection type sensor, and the signal 5 is the output from the auxiliary sensor.
Note 2: The gear angles in Nos. 10 to 12 are the output from the rotation angle detection type sensor in the second rotation.
Note 3: The auxiliary sensor outputs L and H in No. 7 are both detected as the A3 size.

In the table 1, the gear angles in Nos. 10 to 12 in the table 1 show the values in the second rotation of the rotation angle detection type sensor 3S. Moreover, the signals 1 to 4 are the outputs from the rotation angle detection type sensor 3S, and the signal 5 is the output from the auxiliary sensor 4S.

In this embodiment, a SSS-31 type rotary switch (produced by Shinmei Electric Co., Ltd.) is used as the sensor 3S.

The sensor 3S used is of a type outputting four kinds of the signals from the signal 1 to the signal 4 according to the gear angle without distinction of the outputs exceeding one rotation of the gear from the outputs detected within the one rotation.

The sensor of this type has been used in a conventional width detecting device as the detection subject of a relatively small size, and it is adopted as it is so that the configuration is simple and it is advantageous in terms of the cost.

For example, it is adjusted such that the gear angle of the sensor 3S is 0° when the projection 17R is aligned with the postcard scale. At the time, from the sensor 3S, combination signals of H (high level) as the signal 1 (hereinafter the same is applied), L (low level) as the signals 2 to 4 8hereinafter the same is applied), that is, H, L, L, L are output. By inputting the outputs into detector such as a CPU, it is judged that a postcard size paper is placed on the placing base 5.

Similarly, the detection outputs of No. 2 to No. 8 in the table 1 are as follows:

B6 size: gear angle 40.5°: H, H, L, L in the order of the signal 1 to the signal 4

A5 size: gear angle 71.3°: L, H, L, L

B5 size: gear angle 119.9°: L, H, H, L

A4 size: gear angle 184.7°: L, L, H, L

B4 size: gear angle 231.3°: L, L, H, H

A3 size: gear angle 288.1°: L, L, L, H

B3 size: gear angle 351.6°: L, L, L, L.

Since the gear angles from the postcard size to the B3 size have a less than 360° gear angle, the detection outputs corresponding to each paper size are of different combinations, and thus the sizes can be distinguished theoretically.

This rotary switch outputs the same combination signals in a constant range of the gear angle such as the combination signal of No. 1 in the table 1 when the gear angle is "0°" to "less than 40.5°", the combination signal of No. 2 in the table 1 when the gear angle is "40.5°," to "less than 71.3°" (hereinafter it is same in the table 1).

Regarding the case of using only the rotation angle detection type sensor 3S as the sensor, when the gear angle corresponding to B3 is 360°, the combination signals is H, L, L, L as shown in the table 1. Since it is the same as the combination signals for the postcard size, the size cannot be distinguished.

In this embodiment, the auxiliary sensor 4S is provided such that the detection output is changed at an optional position whereat before the gear angle corresponding to the moving amount of the first limiting member 2R converted by the rotation angle detection type sensor 3S exceeds 360° as the boundary. Thereby, the size can be detected also for a wide width paper.

Although it is possible to provide another rotation angle detection type sensor as the auxiliary sensor 4S, a binary output type sensor such as an on-off sensor, capable of judging existence or absence of the first limiting member 2R in the moving range of the first limiting member 2R is used in this embodiment instead of using the rotation angle detection type sensor as the auxiliary sensor. As a sensor of this type, a so-called reflection type sensor of a non contact type and a transmission type sensor are well known, and they can be used. In addition thereto, as it is described later, a contact type sensor for switching on or off the electric contact according to the operation of an actuator (contact), such as a mechanical type micro switch can be used as well.

A reflection type sensor may be used as the auxiliary sensor in a combination with a rotation angle detection type sensor. When the reflection type is used as the auxiliary sensor 4S, a light emitter-receiver 4S1 (see FIGS. 2, 3) is disposed at a position aligned with the A3 scale line. Moreover, the end of the convex portion 10R-3 as the section to be detected is aligned with the projection 17R. Thereby, the detection output from the auxiliary sensor 4S is changed when the projection 17R represents the A3 scale line as the boundary. The light emitter-receiver 4S1 is aligned with the A3 scale line and the detection end by the auxiliary sensor 4S is provided at the A3 size position for improving the total detection result reliability by adding the detection result of the auxiliary sensor 4S before the 360° gear angle position for avoiding the risk of the detection error by providing the same thereat.

In the table 1, a detection signal by the auxiliary sensor 4S is shown as a signal 5. As to the output from the auxiliary sensor 4S, a light output from the light emitter-receiver 4S1 is reflected by the convex portion 10R-3 so as to be input to the light receiver again via the light emitter-receiver 4S1. From the postcard size to the A3 size, L is output. Then, from more than the A3 size to the B3, A2 wide size, since the convex portion 10R-3 as the section to be detected is outside the light emitter-receiver 4S1, due to the absence of the reflected light, H is output.

In the table 1, since there is a detection error in the vicinity of the A3 size, in either case of L or H, it is judged to be the A3 size in combination with the output from the rotation angle detection type sensor.

In the table 1, Nos. 8 to 10 are in the range with the gear angle from 351.6° to 71.3° in the second rotation via 40.5° in the second rotation. In consideration of the error in which the operator positions the projection 17R at the scale position manually in about the range, since the positioning error is ordinarily generated to this extent, for a signal combination in the range, it is judged to be the B3 size in combination with the signal 5 in either case.

As to the A2 size set as the maximum size, as shown in FIG. 1, since the moving limit of the first limiting member 2R is limited by a stopper STP, at the time of the gear angle 119.9° in No. 12, it is judged to be the A3 size by the combination of the outputs L, H, H, L of the signals 1 to 4 and the output H of the signal 5.

Since the reflection type sensor is used as the auxiliary sensor 4S of the rotation angle detection type sensor 3S, miniaturization of the detecting unit can be realized. Furthermore, since the movement of the first limiting member 2R can be transmitted to the rotation angle detection type sensor 3S via the width detecting rack 10R-2 and the interlocking gear 7G, slippage cannot be generated in the motion transmitting path. Therefore, the detection accuracy for the position of the first limiting member 2R (second limiting member 2L) is high as well as the detection accuracy for the paper width is high.

The interlocking gear 7G disposed between the gear 3G of the rotation angle detection type sensor and the width detecting rack 10R-2 is provided for enabling engagement of both of them via the interlocking gear when the gear 3G and the width detecting rack 10R-2 have different heights from the same reference plane, and thus the interlocking gear 7G can be eliminated when direct engagement is feasible, for example, when the heights from the same reference plane is same, the engagement position can be matched by changing the shapes of the gear 3G and the width detecting rack 10R-2, or the like. In this case, the width detecting rack 10R-2 and the gear 3G of the rotation angle detection type sensor can be engaged directly.

Figure 9:
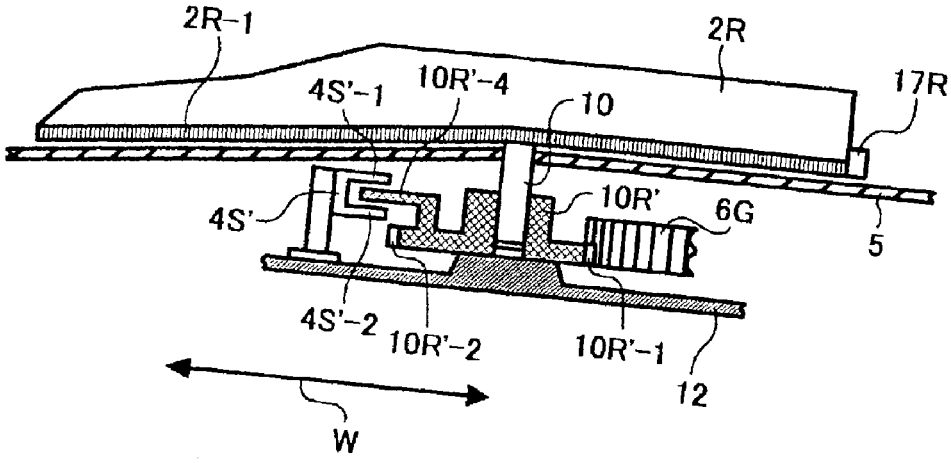
FIG. 9 is an essential part cross-sectional view that explains the positional relationship between a sensor and a rack member when a transmission type auxiliary sensor is used.
Figure 10:
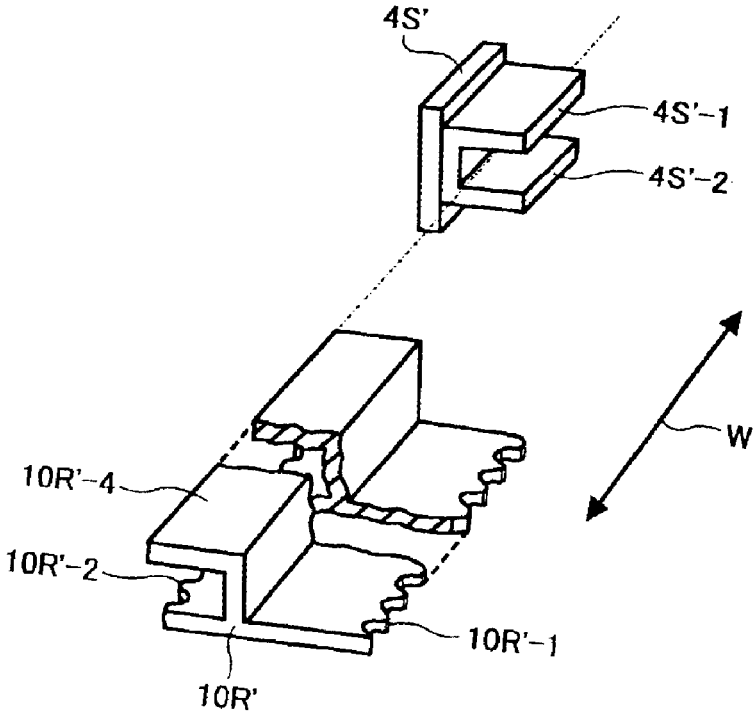
FIG. 10 is a perspective view that explains the positional relationship between the sensor and the rack member when the transmission type auxiliary sensor is used.

As shown in FIGS. 9 and 10, a transmission type sensor may be used as the auxiliary sensor 4S in a combination with a rotation angle detection type sensor.

The auxiliary sensor 4S' comprises a light emission section 4S'-1 and a light receiver 4S'-2 facing with each other with an interval therebetween, with a section to be detected 10R'-4 as a part of a first rack member 10R' provided based on the first rack member 10R, disposed in the space portion of the interval. In the first rack member 10R', the first rack

10R'-1 and the width detecting rack 10R'-2 each correspond to the first rack 10R-1 and the width detecting rack 10R-2 in the first rack member 10R. As in this embodiment, the same effect can be obtained by using the transmission type as the auxiliary sensor 4S instead of the reflection type.

Figure 13:
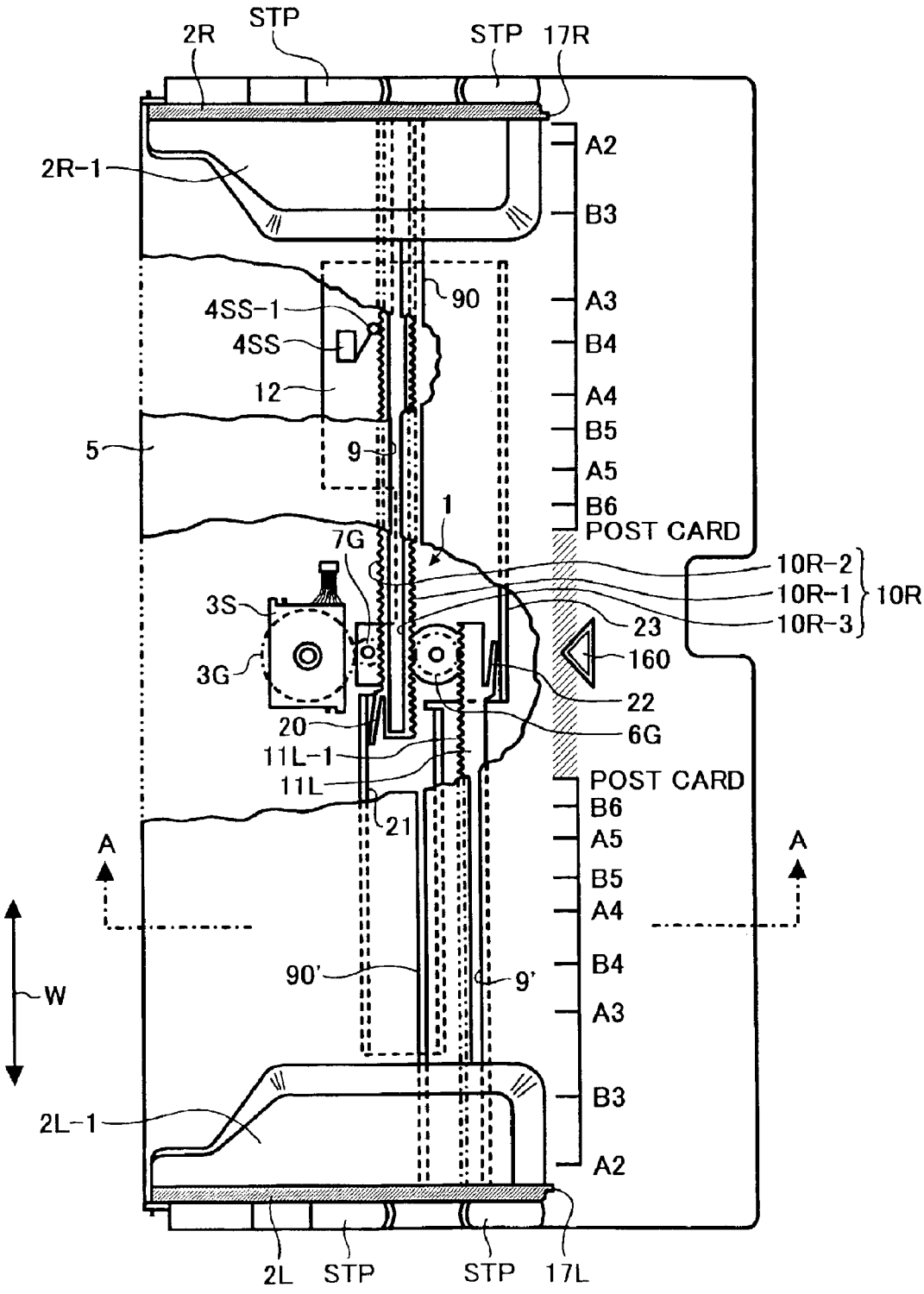
FIG. 13 is a plan view that shows a width detecting device according to another embodiment of the present invention.
Figure 14:
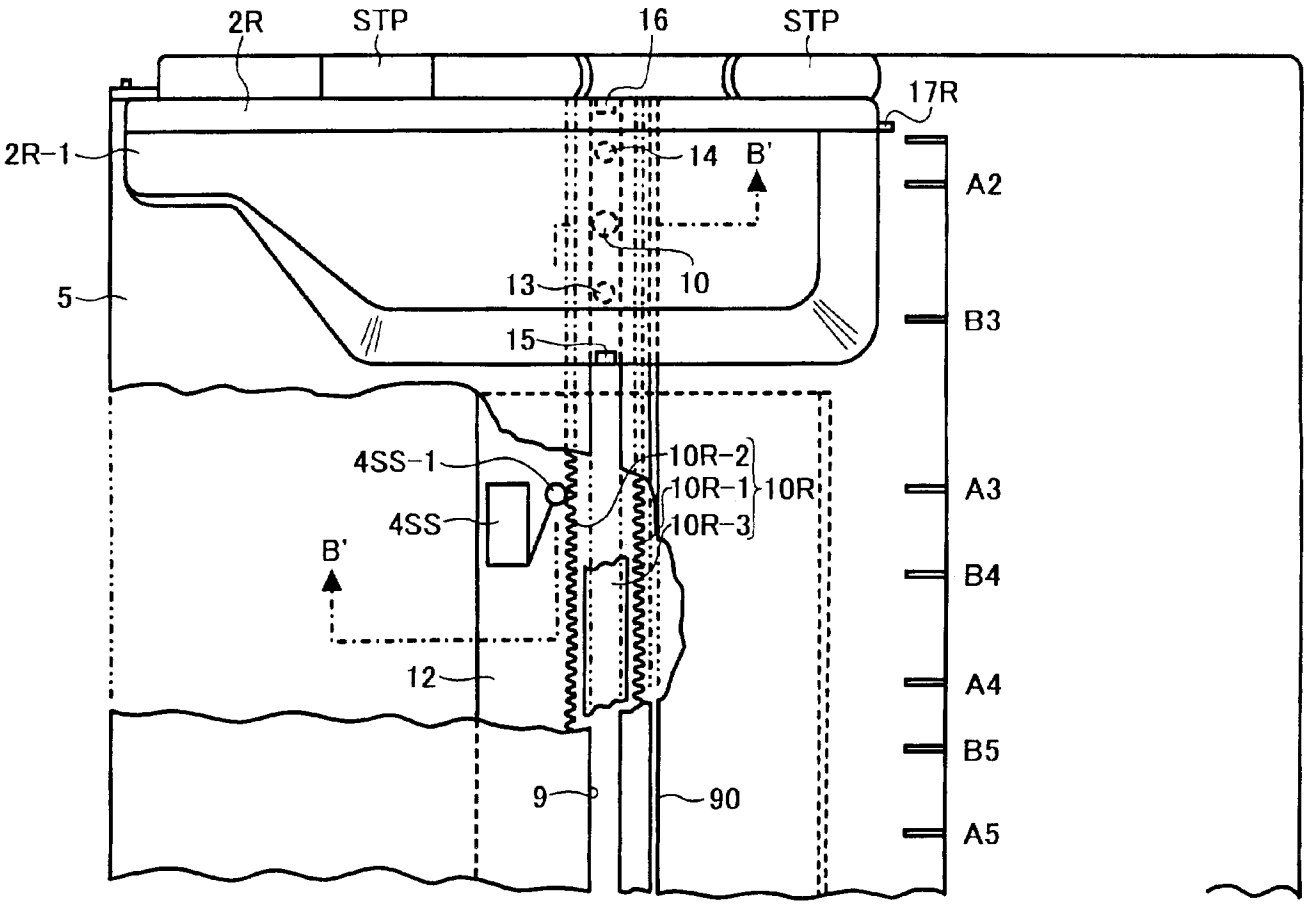
FIG. 14 is an enlarged plan view of a portion of FIG. 13.
Figure 15:
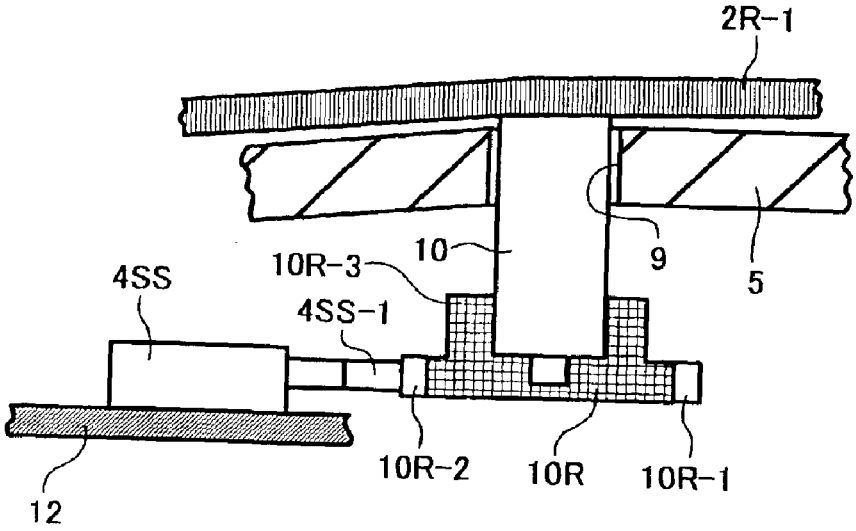
FIG. 15 is a cross-sectional view viewed from the arrows B'—B' of FIG. 14.

A contact type sensor may be used as the auxiliary sensor in a combination with a rotation angle detection type sensor. The contact type sensor is, for example, a micro switch. FIGS. 13 to 16 show an embodiment thereof. FIG. 13 corresponds to FIG. 1, FIG. 14 corresponds to FIG. 2, FIG. 15 corresponds to FIG. 3, and FIG. 16 corresponds to FIG. 8, respectively. In FIGS. 13 to 16, the micro switch as the auxiliary sensor is shown by the numeral 4S. Since the other component members are same as those shown in FIGS. 13 to 16, the same numerals are applied and explanation is omitted as much as possible.

The auxiliary sensor 4S is fixed on the retainer plate 12 according to the embodiment of the auxiliary sensor 4S such that the actuator 4SS-1 thereof is slid against the width detecting rack 10R-2 according to the movement of the first limiting member 2R. In the sliding state (contact), the auxiliary sensor 4S is switched on, and the output at the time is provided as the L output here with regard to the table 1. Then, when the actuator 4SS-1 is in the state displaced from the width detecting rack 10R-2 (non contact), the auxiliary sensor 4S is switched off, and the output at the time is provided as the h output with regard to the table 1.

Figure 16:
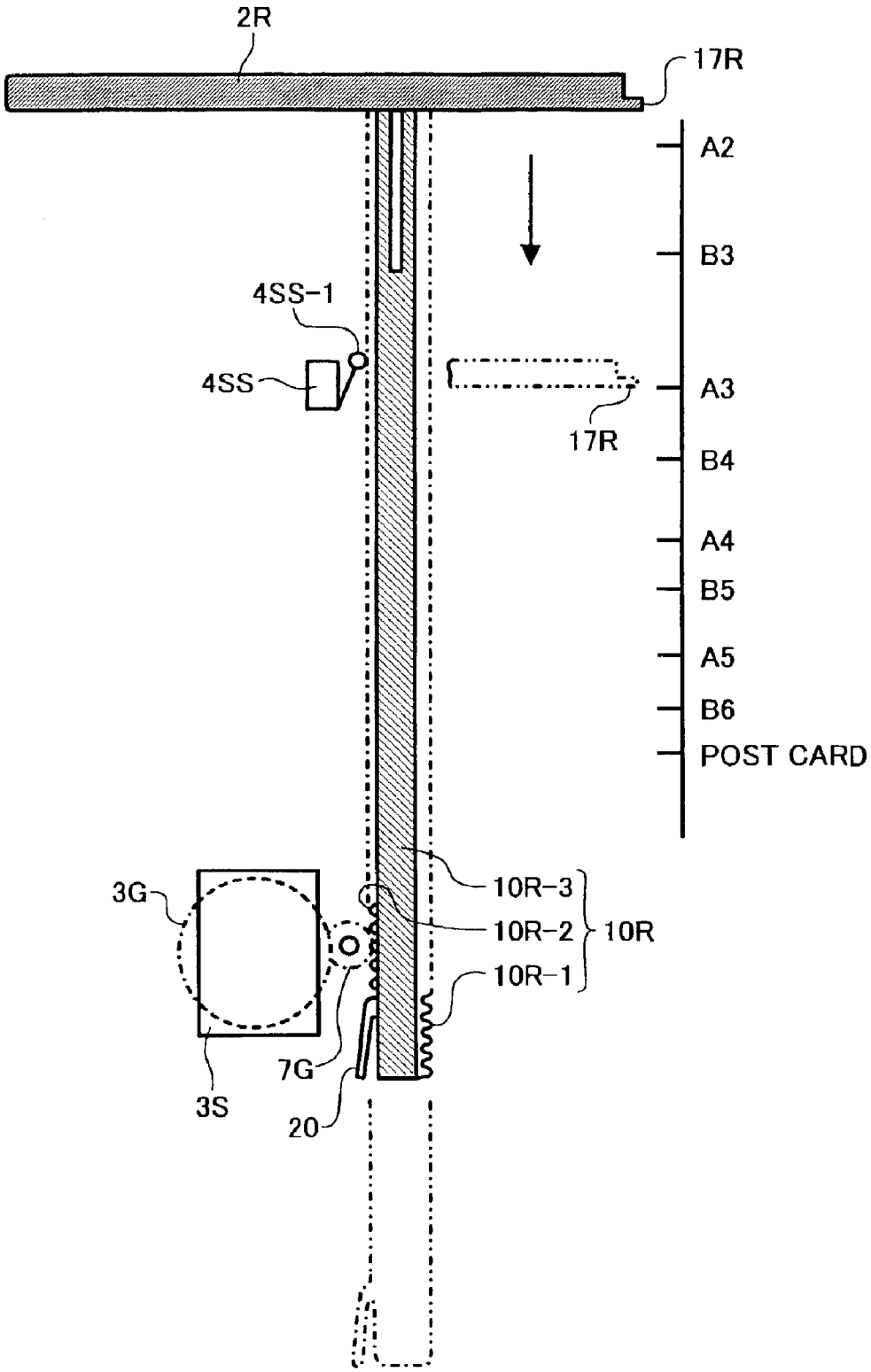
FIG. 16 schematically explains the positional relationship between a first limiting member and sensors.

In this embodiment, as shown in FIG. 16, the auxiliary sensor 4SS position is positioned on the retainer plate 12 such that the actuator 4SS-1 is provided at a positioned aligned with the A3 scale line. Moreover, the end of the width detecting rack 10R-2 as the section to be detected is set at a position coinciding with the projection 17R or a position slightly outer side thereof.

Thereby, the detection output by the auxiliary sensor 4SS is changed at the time the projection 17R of the first limiting member 2R points out the A3 scale line as the boundary. The actuator 4SS-1 is aligned with the A3 scale line and the detection end by the auxiliary sensor 4S is provided at the A3 size position for improving the total detection result reliability by adding the detection result of the auxiliary sensor 4SS before the 360° gear angle (corresponding to B3) for avoiding the risk of the detection error by providing the same thereat.

When the projection 17R of the first limiting member 2R points out from the postcard size to the A3 size, the actuator 4SS-1 of the auxiliary sensor 4SS is pressured by the width detecting rack 10R-2 so that "L" is output from the auxiliary sensor 4SS. Then, for a wide size of more than A3, that is, B3 and A2, since the end of the width detecting rack 10R02 as the section to be detected is displaced from the actuator 4SS-1 so as not to be contacted with the section to be detected, "H" is output. As in this embodiment, the same effect can be obtained by using the contact type sensor as the auxiliary sensor 4SS instead of the non contact type sensor. In contacting the actuator 4SS-1 with the width detecting rack 10R-2, since the module of the rack is smaller than the curvature of the tip end of the actuator 4SS-1, detection error is not generated.

Moreover, the sliding portion of the actuator 4SS-1 as the section to be detected is not limited to the rack section, and one comprising a flat section to be detected can be used. For example, a convex portion 10R-3 can be used as well. In contrast, when the width detecting rack 10R is used as the section to be detected, a configuration without the convex portion 10R-3 can be employed as well.

Since the first rack member 10R is integrated with the supporting section 2R-1 only on the one end side thereof, as to the engaging relationship between the first rack 10R-1 and the motion transmitting pinion 6G, it is provided as the so-called cantilever support. Since there is a distance between the integrated portion and the motion transmitting pinion 6G, the risk is involved in that the engaging state can be unstable derived from departure of the first rack 10R-1 from the motion transmitting pinion 6G due to the force applied between the rack and the pinion at the time of transmitting the motion. Then, in order to stably support the engaging relationship, a tooth skipping preventing unit is provided. The same is applied to the second rack member 11L.

Figure 8:
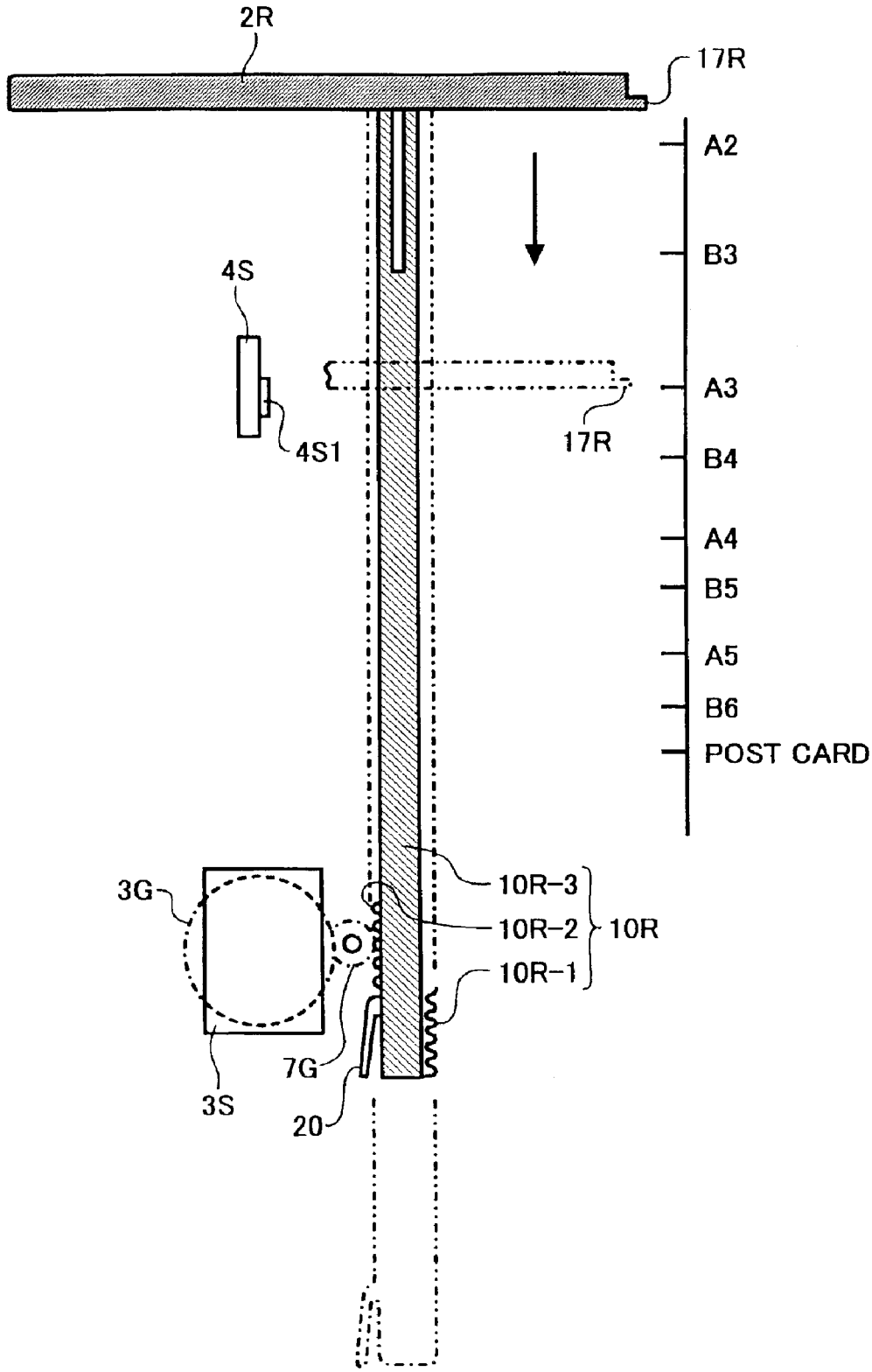
FIG. 8 schematically explains the positional relationship between the first limiting member and sensors.

As shown in FIGS. 1, 6, 8, or the like, as to the first rack member 10R, the tooth skipping preventing unit comprises a component portion with a fin-like small piece 20 projecting outward from the side portion of the free end on the opposite side with respect to the integrated portion of the rack member 10R with the first limiting member 2R, and a slider 21 provided by bending the small piece 20 upright in an L shape on the end part of the retainer plate 12 in the moving range of the small piece 20 to be moved with the first rack member 10R such that the small piece 20 is slide against the slider 21 while being pressured by the elastic force.

Since the first rack member 10R is pressured by the motion transmitting pinion 6G by the elastic force of the small piece 20, skipping of a tooth can be prevented. As to the first rack member 10R, the width detecting rack 10R-2 on the opposite side of the motion transmitting pinion 6G is engaged with the interlocking gear 7G and the interlocking gear 7G is supported between the placing base 5 and the retainer plate 12, the interlocking gear 7G serves also as a tooth skipping preventing unit. As shown in FIG. 5, the upper surface portion of the retainer plate 12 is made thicker at a position of receiving the free end side of the first rack member 10R for providing a receiver 12*a* for preventing sagging of the first rack member 10R by its self weight.

Similarly, as to the second rack member 11L, as shown in FIGS. 1, 5, or the like, a fin-like small piece 22 is provided on the free end of the second rack member 11L, and a slider 23 is provided by bending the side portion of the retainer plate 12 upright in an L shape in the moving range of the small piece 22 to be slid against the slider 23 for serving as a tooth skipping preventing unit. Moreover, the upper surface portion of the retainer plate 12 is made thicker at a position of receiving the free end side of the second rack member 11L for providing a receiver 12*b* for preventing sagging of the first rack member 10R by its self weight.

According to the tooth skipping preventing units, furthermore, since the auxiliary sensor 4S (or the auxiliary sensor 4S', 4SS) is supported by the retainer plate 12, the operation of the first rack member 10R, the second rack member 11L, and the motion transmission accompanying the same are stabilized so that engagement of the interlocking gear 7G or the gear 3G of the rotation angle detection type sensor 3S and detection by the auxiliary sensor 4S (or the auxiliary sensor 4S', 4SS) can be highly accurate so that the paper width can be detected further accurately.

In the above mentioned embodiments, the paper widths of various sizes from the postcard size to the A2 size are detected by switching the output of the auxiliary sensor 4S (or the auxiliary sensor 4S', 4SS) between L and H at a position immediately before having the gear 3G of the rotation angle detection type sensor 3S exceeding 360 degrees (one rotation), and combining the output from the auxiliary sensor 4S (or the auxiliary sensor 4S', 4SS) and the output from the rotation angle detection type sensor 3S.

Figure 11:
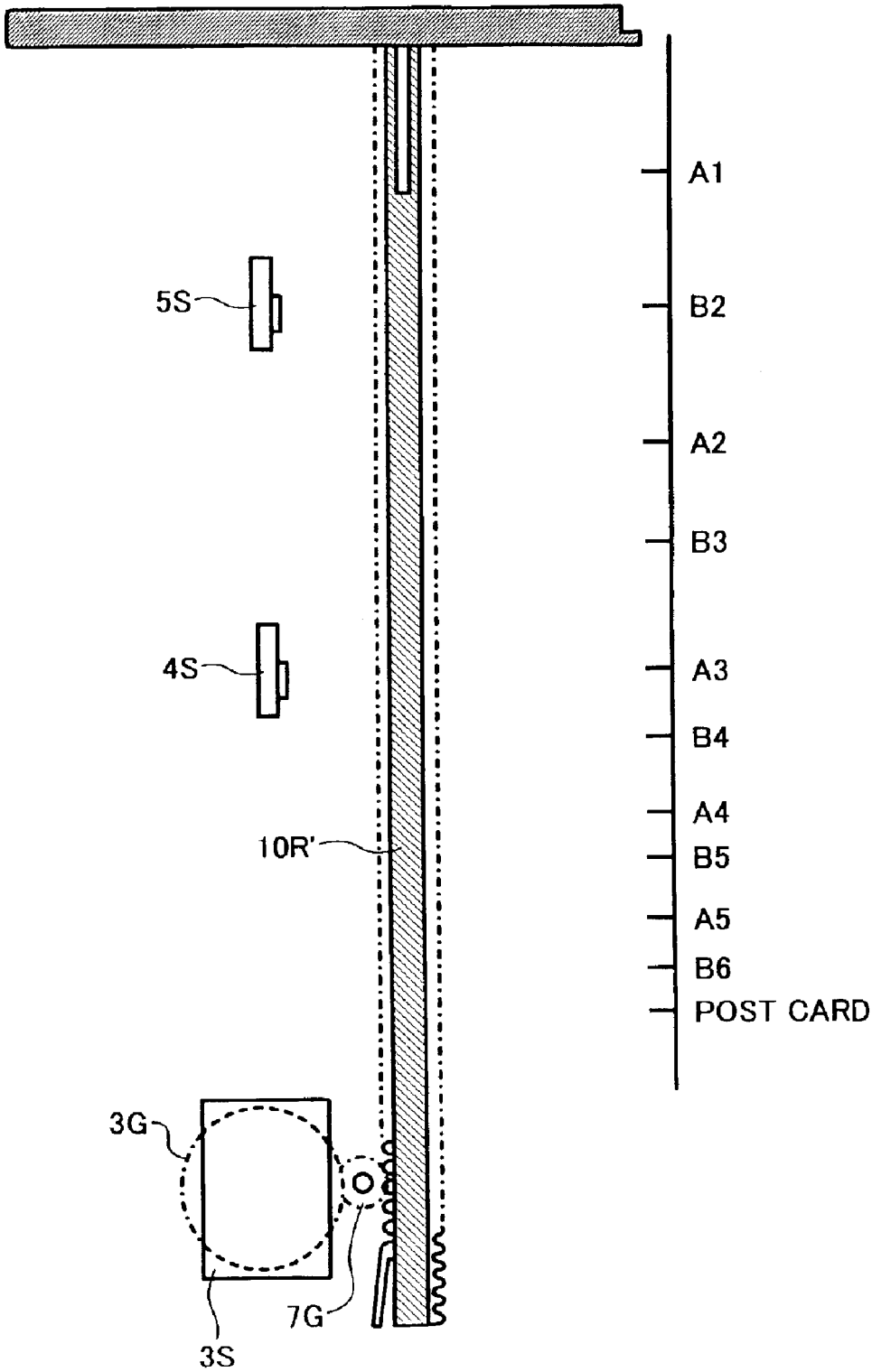
FIG. 11 schematically explains the positional relationship between a first limiting member and sensors when a plurality of auxiliary sensors is used.

Furthermore, in order to enable the size detection of a larger size paper, such as the B2 and A1 sizes, as shown in FIG. 11, a first rack member 10R' and a second limiting member 11L' (not shown) with the length prolonged than the first rack member 10R and the second limiting member 11L in the embodiments, and an auxiliary sensor 5S is provided in addition to the auxiliary sensor 4S for adding a signal 6 to the table 1 column as the output of the added auxiliary sensor 5S so that it can be dealt with by switching the output from the auxiliary sensor 5S at a position immediately before having the gear 3G of the rotation angle detection type sensor 3S exceeding 720 degrees (2 rotations) between L and H.

Figure 17:
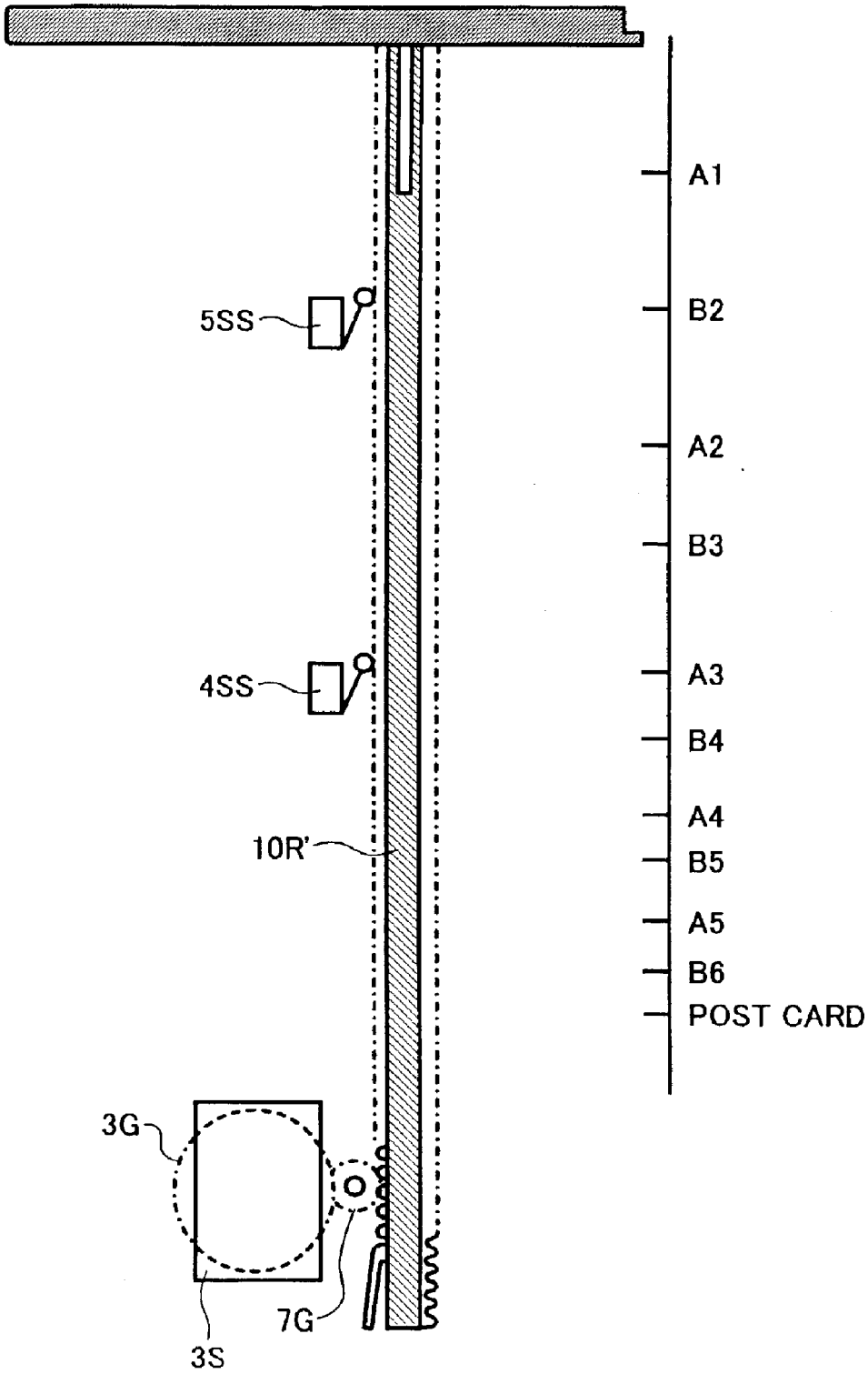
FIG. 17 schematically explains the positional relationship between a first limiting member and sensors when auxiliary sensors are used.

Similarly, also in the case of using a transmission type auxiliary sensor 4S', although it is not shown, it can be dealt with by adding another transmission type sensor according to the auxiliary sensor 5S. Furthermore, in the case of a contact type sensor, as shown in FIG. 17, an auxiliary sensor 5SS is provided in addition to the auxiliary sensor 4SS for providing the same function as that of the auxiliary sensor 5S.

Accordingly, in addition to the non contact type such as the reflection type and the transmission type, by providing an auxiliary sensor of a simple configuration such as a contact type sensor at a position capable of detecting the first rack member by two or in a plurality of three or more as needed, the paper width detectable range can be enlarged in a small space at a low cost so as to increase the number of detections.

The width detecting devices according to the above mentioned embodiments can be used in a manual feeding device in a printer, a facsimile, an image formation apparatus, or the like, or an automatic document feeder (ADF) attached to the image formation apparatus.

When the width detecting device is used for a manual feeding device, the size of the paper to be fed manually is input to a controlling unit of the image formation apparatus as an electric signal so that the image formation process is executed based on the paper size information. When it is used for an automatic document device, similarly, a signal including the size information is input to a reading controlling unit so that the reading scanning width is set.

Hereinafter, with reference to FIG. 12, an embodiment of an image formation apparatus comprising a manual feeding device and an automatic document device is explained.

Figure 12:
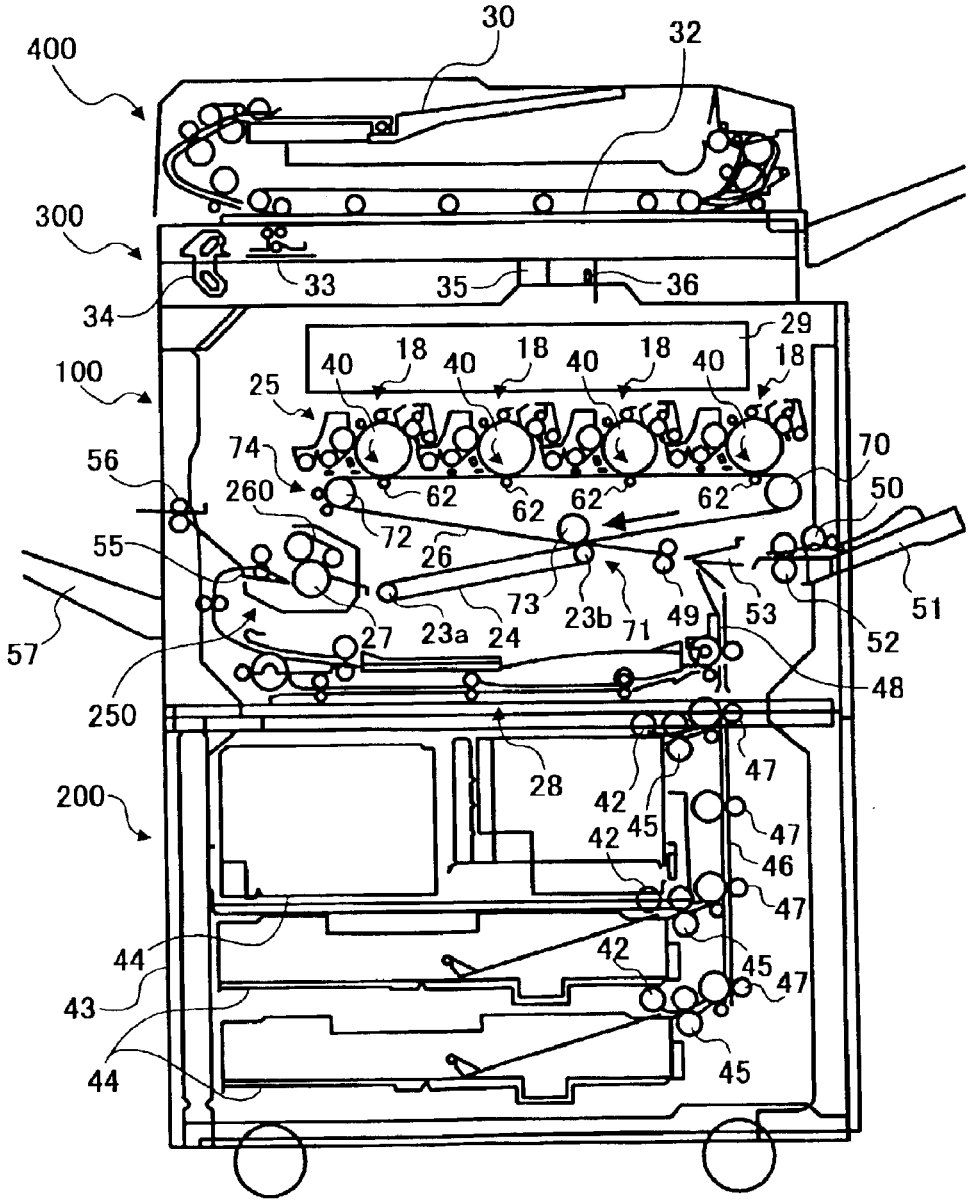
FIG. 12 shows an example of the configuration of an image formation apparatus.

In FIG. 12, a reference numeral 100 represents a copying machine main body, a reference numeral 200 represents a paper feeding table for placing the same, a reference numeral 300 represents a scanner to be mounted on the copying machine main body 100, and a reference numeral 400 represents an automatic document device to be mounted further thereon. With these elements assembled together, the image formation apparatus is provided.

In the copying machine main body 100, an endless belt-like intermediate transfer member 26 is provided in the center.

As shown in FIG. 12, the endless belt-like intermediate transfer member 26 is hung around three supporting rollers 70, 72, and 73 so as to be enable rotation and conveyance in the clockwise direction in the figure. Moreover, an intermediate transfer member cleaning device 74 is provided on the left side of the second supporting roller 72 out of the three rollers for eliminating the residual toner remaining on the intermediate transfer member 26 after the image transfer.

On the intermediate transfer member 26 placed between the first supporting roller 70 and the second supporting roller 72 out of the three rollers, four image formation units 18 of black, cyan, magenta and yellow are arranged side by side along the conveyance direction so as to provide a tandem image formation section 25. As shown in FIG. 12, an exposing device 29 is provided on the tandem image formation section 25.

A secondary transfer device 71 is provided on the opposite side of the tandem image formation section 25 with respect to the intermediate transfer member 26. In this embodiment, the secondary transfer device 71 provided by placing a secondary transfer belt 24 as an endless belt around two rollers 23*a*, 23*b*, is provided in the state forced against the third supporting roller 73 via the intermediate transfer member 26 for transferring an image on the intermediate transfer member 26 to a paper.

A fixing device 250 is provided on the side of the secondary transfer device 71 for fixing the image transferred on the paper. The fixing device 250 is provided by forcing a pressuring roller 27 against a fixing belt 260 as an endless belt 260.

The secondary transfer device 71 also has a paper conveying function for conveying the paper after the image transfer to the fixing device 250. Of course a non contact type charger may be disposed as the secondary transfer device 71. In this case, it is difficult to have the paper conveying function.

In this embodiment, a paper inverting device 28 is provided parallel to the tandem image formation section 25 below the secondary transfer device 71 and the fixing device 250 for inverting the paper for recording an image on the both sides of the paper.

For copying with the color copying machine, a manuscript is set on a manuscript base 30 of the automatic document device 400. In the automatic document device, the width detecting device of the present invention is used so that the manuscript width is recognized automatically. Alternatively, a manuscript is set on a contact glass 32 of the scanner 300 by opening the automatic document device 400 and closing the automatic document device 400 for weighting thereby.

When a manuscript is set on the automatic document device 400 and a start switch (not shown) is pressed, the manuscript is first conveyed onto the contact glass 32. In contrast, when a manuscript is set on the contact glass 32, the scanner 300 is driven immediately so as to run a first running member 33 and a second running member 34. A light is emitted from a light source by the first running member 33 as well as the reflected light from the manuscript surface is further reflected toward the second running member 34 so as to be reflected by a mirror of the second running member 34 for inputting the same into a reading sensor 36 via an image forming lens 35 for reading the manuscript content. As the manuscript reading device, a type of utilizing a laser beam can be used as well. In any case, the scanning width for scanning the manuscript can be set based on the paper width information from the width detecting device according to the present invention. Moreover, the developing area by the developing unit can be set and the erasure width after photosensitive member primary charging can be set in the image formation unit 18.

When the start switch is pressed, one of the supporting rollers 70, 72, 73 is rotated and driven by the driving motor for driving the other two supporting rollers following thereto so as to rotate and convey the intermediate transfer member 26. At the same time, the photosensitive member 40 is rotated by each image formation unit 18 for forming a single color image of black, yellow, magenta, and cyan on each photosensitive member 40.

That is, at the time of image formation, while rotating the photosensitive member 40, first the surface of the photosensitive member 40 is charged uniformly by the charging device, and then a writing light Lb of a laser, by an LED, or the like is irradiated from the exposure device 21 according to the reading content by the scanner 300 for forming an electrostatic latent image on the photosensitive member 40. Thereafter, a toner is adhered by the developing device that visualizes the electrostatic latent image.

According to the conveyance of the intermediate transfer member 26, the single color images thereof are transferred successively by the primary transfer device 62 so as to form a composite color image on the intermediate transfer member 26. For the surface of the photosensitive member 40 after the image formation, the residual toner is eliminated for cleaning by the photosensitive member cleaning device, and the charge is eliminated by the charge eliminating device that prepares itself to the next image formation.

When the start switch is pressed, one of paper feeding rollers 42 of the paper feeding table 200 is selected and rotated for taking out papers from one of multi stage paper banks 43 provided in a paper feeding cassette 44, separating the same one by one by a separating roller 45, introducing to a paper feeding path 46 for conveying by a conveying roller 47, guiding into a paper feeding path 48 in the copying machine main body 100, and butting against a resist roller 49 so as to be stopped.

Alternatively, papers are taken out from a manual feeding device 51 with the width detecting device of the present invention by rotating a paper feeding roller 50 for separating the same one by one by a separating roller 52, introducing to a paper feeding path 53, and similarly butting against the resist roller 49 so as to be stopped.

The resist roller 49 is rotated with the timing matched with the composite color image on the intermediate transfer member 26. A paper is sent into between the intermediate transfer member 26 and a secondary transfer device 71 for transferring by the secondary transfer device 71 so as to form a color image on the paper.

The paper after the image transfer is conveyed by the secondary transfer device 71 so as to be sent into the developing device 25. After fixing the transferred image by applying the heat and the pressure by the fixing device 25, it is discharged by a discharge roller 56 according to changeover by a switching pawl 55 so as to be stacked on a paper discharge tray 57. Alternatively, it is input into the paper inverting device 28 according to changeover by the switching pawl 55 so as to be inverted and guided again to the transfer position for recording an image also on the rear side, and it is discharged onto the paper discharge tray 57 by the discharge roller 56.

For the intermediate transfer member 26 after the image transfer, the residual toner remaining on the intermediate transfer member 26 after the image transfer is eliminated by the intermediate transfer member cleaning device 74 for preparing itself to the next image formation by the tandem image formation section 25.

In the tandem type image formation section 25, as it is known, each image forming unit 18 comprises a charge device, a developing device, a primary transfer device, a photosensitive member cleaning device, a charge eliminating device, or the like around the drum-like photosensitive member 40. In this embodiment, the photosensitive member 40 is a drum-like rotating member with a photosensitive layer formed on a bare pipe of an aluminum, or the like by coating an organic photosensitive material having the photosensitive property, but it may be an endless belt-like rotating member.

In the developing device, a developing sleeve is provided facing the photosensitive member 40 as well as a magnet is fixed in the developing sleeve. Moreover, a doctor blade is provided with the tip end adjacent to the developing sleeve.

FIG. 12 merely shows a tandem type full color image apparatus as an embodiment of the image formation apparatus. The width detecting device according to the present invention is not limited to the image formation apparatus shown in FIG. 12, and it can be used widely in an apparatus comprising an image formation section for forming an image on a paper, such as an image formation apparatus of a type comprising a manual feeding device, and an image formation apparatus comprising an automatic document device. Needless to say, it can be used also to a manual feeding device and an automatic document device for an electrophotography system image formation apparatus for a black and white image, a printer, a facsimile or the like.

According to the first aspect of the invention, the width of a wide size sheet-like medium can be detected in a compact configuration.

According to the second aspect of the invention, even in the case of using a rotation angle detection type sensor of a simple configuration, a wide size can also be detected according to a combination with an auxiliary sensor. According to the third aspect of the invention, it can be executed easily by using a simple sensor.

According to the fourth aspect of the invention, since the movement of the limiting member is detected by each sensor, utilizing the gear engaging relationship, owing to absence of generation of slippage in the motion transmitting path, a high detection accuracy can be provided.

According to the fifth aspect of the invention, the operation of the first and second rack members can be stabilized by preventing tooth skipping so that detection by the sensor utilizing the gear engaging relationship can be highly accurate so that the width can be detected highly accurately.

According to the sixth aspect of the invention, the size of a wider sheet-like medium can be detected.

According to the seventh aspect of the invention, the width size can be detected automatically in an image formation apparatus comprising a manual feeding device or an automatic document device that handles a wide sheet-like medium.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A width detecting device for detecting a width of a sheet-like medium, comprising:

a placing base for placing a sheet-like medium having a first side and a second side perpendicular to a width direction of the sheet-like medium;

a first limiting member situated on the first side and a second limiting member situated on the second side of the sheet-like medium;

an interlocking unit that moves the first limiting member and the second limiting member along the width direction;

a rotation angle detection sensor that detects an angle based on positions of the first limiting member and the second limiting member and outputs an angle signal based on the angle;

an auxiliary sensor that judges any one of presence and absence of the first limiting member and the second limiting member in a moving range of the first limiting member and the second limiting member and outputs a presence and/or absence signal based on the judgment; and a width detection sensor that detects the width of the sheet-like medium based on the angle signal and the presence and/or absence signal.

2. The width detecting device according to claim 1, wherein the auxiliary sensor is provided in plurality.

3. The width detecting device according to claim 1, wherein the auxiliary sensor changes the presence and/or absence signal to indicate presence from absence or vice versa when the angle measured by the rotation angle detection type sensor is less than a predetermined angle to 360°.

4. The width detecting device according to claim 1, wherein the auxiliary sensor is any one of a non contact type and contact type binary output type sensor.

5. The width detecting device according to claim 1, wherein the interlocking unit comprises:

a first rack member provided integrally with the first limiting member and having a first rack formed in the width direction;

a second rack member provided integrally with the second limiting member and having a second rack formed in the width direction, facing the first rack; and a motion transmitting pinion to be engaged commonly with the first rack and the second rack, wherein for the first rack member, a width detecting rack is formed on the rear side of the first rack such that the width detecting rack is engaged with a gear of the rotation angle detection type sensor via one of the gear that is engaged with the width detecting rack and directly without using the gear.

6. The width detecting device according to claim 5, further comprising a tooth skipping preventing unit that prevents the first rack and the second rack from moving away from the gear.

7. An image formation apparatus comprising:

a medium feeding unit that feeds a sheet-like medium having a first side and a second side perpendicular to a width direction of the sheet-like medium, the medium feeding unit feeding the sheet-like medium with any one of an automatic and manual operation;

a placing base for placing the sheet-like medium;

a first limiting member situated on the first side and a second limiting member situated on the second side of the sheet-like medium;

an interlocking unit that moves the first limiting member and the second limiting member along the width direction;

a rotation angle detection sensor that detects an angle based on positions of the first limiting member and the second limiting member and outputs an angle signal based on the angle; and an auxiliary sensor that judges any one of presence and absence of the first limiting member and the second limiting member in a moving range of the first limiting member and the second limiting member and outputs a presence and/or absence signal based on the judgment; and a width detection sensor that detects the width of the sheet-like medium based on the angle signal and the presence and/or absence signal.

* * * * *